US011255058B2

(12) United States Patent
Congost

(10) Patent No.: US 11,255,058 B2
(45) Date of Patent: Feb. 22, 2022

(54) ASPHALT AGGREGATE PAVER FOR ASPHALTING A SURFACE TO BE ASPHALTED

(71) Applicant: AGUSTÍ Y MASOLIVER, S.A., Banyoles (ES)

(72) Inventor: Marc Echave Congost, Banyoles (ES)

(73) Assignee: AGUSTI Y MASOLIVER, S.A., Banyoles (ES)

( * ) Notice: Subject to any disclaimer, the term of this patent is extended or adjusted under 35 U.S.C. 154(b) by 35 days.

(21) Appl. No.: 16/755,946

(22) PCT Filed: Oct. 5, 2018

(86) PCT No.: PCT/ES2018/070651
§ 371 (c)(1),
(2) Date: Apr. 14, 2020

(87) PCT Pub. No.: WO2019/077177
PCT Pub. Date: Apr. 25, 2019

(65) Prior Publication Data

US 2021/0189666 A1 Jun. 24, 2021

(30) Foreign Application Priority Data

Oct. 16, 2017 (ES) ..... ES201731224U

(51) Int. Cl.
*E01C 19/48* (2006.01)
*E01C 19/46* (2006.01)
*E01C 19/45* (2006.01)

(52) U.S. Cl.
CPC ..... *E01C 19/46* (2013.01); *E01C 19/45* (2013.01); *E01C 19/48* (2013.01)

(58) Field of Classification Search
CPC ..... E01C 19/45; E01C 19/46; E01C 19/48
(Continued)

(56) References Cited

U.S. PATENT DOCUMENTS 5,590,976 A * 1/1997 Kilheffer ..... E01C 19/46 404/72
6,071,040 A 6/2000 Macku et al.
(Continued)

FOREIGN PATENT DOCUMENTS

FR 1443136 6/1966
GB 1355620 6/1974

OTHER PUBLICATIONS

International Search Report For Serial No. PCT/ES2018/070651 dated Jan. 29, 2019.

*Primary Examiner* — Raymond W Addie
(74) *Attorney, Agent, or Firm* — McCormick, Paulding & Huber PLLC

(57) ABSTRACT

An asphalt aggregate paver (1) for asphalting a surface (116) to be asphalted includes an asphalt aggregate receiving hopper (2), width-wise spreading means (4) for distributing the aggregate over the surface (116), and conveyor means (6) arranged between the receiving hopper (2) and the spreading means (4) for feeding said spreading means (4), by conveying said aggregate from the hopper to said spreading means (4) in a longitudinal direction (L). The paver further includes mixing means (8), which are a separate element of said conveyor means (6). The mixing means (8) are arranged between said receiving hopper (2) and said spreading means (4), and the mixing means (8) are movable with respect to the conveyor means (6) for stirring the aggregate when it is conveyed. The mixing means (8) are arranged outside and after the receiving hopper (2).

19 Claims, 7 Drawing Sheets

(58) Field of Classification Search
USPC ..... 404/83–118
See application file for complete search history.

(56) References Cited

U.S. PATENT DOCUMENTS

| | | | | |
|---|---|---|---|---|
| 7,458,746 | B1 * | 12/2008 | Zimmerman | E01C 19/1054<br>404/101 |
| 2004/0223808 | A1 | 11/2004 | Romier et al. | |
| 2011/0044758 | A1 * | 2/2011 | Utterodt | E01C 19/486<br>404/118 |

* cited by examiner

ASPHALT AGGREGATE PAVER FOR ASPHALTING A SURFACE TO BE ASPHALTED

CROSS-REFERENCE TO RELATED APPLICATIONS

This application is a National Stage application of International Patent Application No. PCT/ES2018/070651, filed on Oct. 5, 2018, which claims priority to Spanish Patent Application No. U201731224 filed on Oct. 16, 2017, each of which is hereby incorporated by reference in its entirety.

TECHNICAL FIELD

The invention relates to an asphalt aggregate paver for asphalting a surface to be asphalted, said paver comprising a receiving hopper for receiving asphalt aggregate, width-wise spreading means for distributing said aggregate over said surface to be asphalted, and conveyor means arranged between said receiving hopper and said spreading means for feeding said spreading means, by conveying said aggregate from said receiving hopper to said spreading means in a longitudinal direction.

BACKGROUND

In the process of asphalting a public thoroughfare, it is necessary to spread the asphalt aggregate uniformly width-wise across the thoroughfare in order to then compact it.

In the invention, when the term "aggregate" is used, it refers to an asphalt aggregate.

The machinery intended for spreading asphalt aggregate over the public thoroughfare to be asphalted is known in the art as a paver. The purpose of a paver is to spread or scatter a uniform layer of agglomerate as it moves forward across the entire width of the machine which must subsequently be compacted by a suitable road roller working behind the paver.

The asphalt agglomerate comes from asphalt production sites located far away from the public thoroughfare that is being asphalted. Dump trucks that are open in the upper part and simply covered with a tarp are used to transport the agglomerate. The purpose of the tarp is to reduce temperature losses of the aggregate as much as possible between the production site and the public thoroughfare to be asphalted. The tarp also has the purpose of preventing the aggregate to be eventually harmed. Nevertheless, temperature losses are unavoidable and always occur to a greater or lesser extent.

A conventional dump truck for asphalt may transport several tons of aggregate in each trip. Dump trucks often transport in the order of 25 tons of product.

Due to the considerable mass that is transported, cooling takes place in the outermost layer of the aggregate mass. On the contrary, the inner part of the mass virtually remains at a constant temperature and loses little temperature until it is used for the asphalting process.

The asphalt aggregate production temperature is between 160 and 180° C. In turn, the optimal on-site application temperature is in the order of 140° C. Despite the fact that the inner part of the aggregate mass contained in the dump truck may maintain a suitable temperature above the suitable temperature, it is not uncommon for the surface layer to cool down to 100° C.

Temperatures in the asphalt aggregate mass that are too low before said mass is spread over the public thoroughfare to be asphalted lead to a deficient asphalting quality. Above all, if the spreading temperature is heterogeneous and low, the compacting process by means of the road roller is also more deficient. This leads to minimal irregularities on the asphalted surface that facilitate early deterioration of the public thoroughfare.

Therefore, the more homogeneous and higher the temperature of the aggregate during its application, the better the asphalting quality.

An asphalting method shown in FIG. 1 for asphalting large surfaces, and more particularly for asphalt wearing courses, is known in the state of the art.

The direction of spreading the aggregate corresponds to the forward movement direction of the machines of FIG. 1, depicted by arrow A.

A dump truck 100 with the asphalt aggregate mass is located in the front. The dump truck 100 deposits the aggregate mass, not shown in detail, in a first hopper 104 of an asphalt transfer machine, referred to in the art as a transfer machine 102. The aggregate mass for filling the first hopper may amount to 7 tons. In this particular method, worm screws mixing the aggregate mass in order to homogenize its temperature are arranged inside this first hopper 104. This method involves certain cooling of the aggregate mass.

After the homogenization process, the aggregate mass is conveyed by means of a first conveyor belt 106 to the rear part of the transfer machine 102.

The first conveyor belt 106 drops the asphalt mass inside a second hopper 110 of a paver 108, the aggregate mass having a homogeneous temperature. Inside this second hopper 108 there is mounted a second conveyor belt, not shown, which drops the aggregate onto a first worm screw 112 that distributes it width-wise across the surface 116 to be asphalted.

Behind the first worm screw 112 there is provided a level 114 that is in charge of distributing the aggregate more uniformly width-wise across the surface, in the forward movement direction.

Simultaneously, a road roller, which is not shown in the drawings and which circulates behind the paver, is in charge of the final compaction of the asphalted surface.

The asphalting train, i.e., the assembly that moves together formed by the dump truck 100, transfer machine 102, and paver 108, moves forward together until the dump truck 100 has dumped its entire contents into the transfer machine 102.

When the dump truck 100 is empty, it is moved away from the transfer machine 102 and a new dump truck 100 is provided for feeding the transfer machine 102 with more aggregate.

This solution is complex and requires an enormous investment in machinery. This has a direct effect on the asphalting cost and makes the public work unnecessarily more expensive.

SUMMARY

It is an object of the invention to provide an asphalt aggregate paver of the type indicated above, which allows asphalting surfaces and achieving a better surface finish but in a simple and cost-effective manner.

Furthermore, the invention has to increase the flexibility and maneuverability during the known asphalting methods. In that sense, the paver must allow working in public thoroughfares having very different characteristics, such as large highways or winding streets.

This purpose is achieved by means of a paver of the type indicated above, characterized in that it further comprises mixing means, said mixing means being a separate element of said conveyor means, said mixing means being arranged between said receiving hopper and said spreading means and said mixing means being movable with respect to said conveyor means for stirring said aggregate when it is conveyed from said receiving hopper to said spreading means, and said mixing means being arranged outside and after said receiving hopper.

In particular, the mixing means are located behind the receiving hopper in the forward movement direction of the asphalting train.

This solution has a number of advantages with respect to the solutions known in the state of the art.

Firstly, the asphalting method is considerably simplified. Thanks to the mixing means being provided in the paver, the temperature of the asphalt aggregate can be homogenized like in the known method. Nevertheless, it is no longer necessary to place a transfer machine between the dump truck and the paver.

The mixing means can mix the aggregate mass in different ways. It is simply necessary for the mixing means to move with respect to the conveyor means, either by a linear movement in the direction opposite the forward movement direction of the aggregate mass, such as for example by means of a system of combs, by rotation, by means of an undulating movement, or the like. The existence of relative movement between both parts is enough for the outermost layer of the aggregate mass to be mixed with the inner layer and for the total temperature of the mass to become homogeneous. The more movement there is between layers, the better the homogenization.

Furthermore, by dispensing with a transfer machine, the cost of asphalting drops dramatically. In fact, due to its high cost, the known method with transfer machines can be applied to only some wearing courses. In contrast, as a result of the simplification represented by the paver according to the invention, the novel method can be applied to any type of public thoroughfares and on all the asphalt layers desired. Nonetheless, the cost is not considerably higher than that of the method not including homogenization.

On the other hand, the surface finish is the same or better than in the case of the method using the transfer machine. By eliminating the transfer machine, the time and distance between the point in which asphalt aggregate is stirred and its temperature is homogenized and the point in which it is finally deposited on the surface to be asphalted is also reduced. Therefore, in addition to homogenizing the asphalt aggregate, temperature losses therein are reduced. This is favourable for subsequent tamping, because if the aggregate mass arrives on site at borderline temperatures, it is important to prevent considerable temperature losses in addition to those taking place during transport.

Another synergistic effect obtained as a result of the paver according to the invention consists of the method being much more flexible. The length of the asphalting train is smaller. Now only the dump truck and paver are required in the asphalting train. The transfer machine is no longer required. Therefore, it is easier to maneuver the assembly and much narrower surfaces can be asphalted, such as windy streets, small roads having smaller radius of curvature.

Finally, the fact that the mixing means are outside of the receiving hopper assures that the dump truck cannot collide with them and jeopardize the operation of the paver.

The invention further includes a number of preferred features that are object of the dependent claims and the utility of which will be highlighted hereinafter in the detailed description of an embodiment of the invention.

In one embodiment, said mixing means are arranged inside a casing, after said receiving hopper, separating said mixing means from said receiving hopper. Not only does this eliminate the risk of any collision with the dump truck, but it furthermore hinders any possible recirculation of aggregate to the receiving hopper. On the other hand, usage safety of the paver also increases.

In a particularly preferred manner, said mixing means are arranged above said conveyor means, such that the aggregate mass is maximally utilized, since the lower support surface are the conveyor means themselves.

In another embodiment, the distal end of said mixing means adjacent to said conveyor means is arranged at a distance comprised between 10 and 70 mm above said conveyor means and more preferably between 20 and 50 mm. This provides optimal mixing for homogenizing the temperature. The mixing means getting jammed against the conveyor means are simultaneous prevented.

Preferably, said mixing means are rotatably mounted about an axis. As a result, the asphalt aggregate mass is stirred with greater intensity than by means of linear movements in a direction different from the direction of conveyance of the mass. As a result, a more homogeneous homogenization is achieved.

In another particularly preferred embodiment, said mixing means comprise at least one rotor with a plurality of blades, said at least one rotor being rotatably mounted about an axis transverse to the longitudinal direction of said paver. The effect of the blades maximizes homogenization of the aggregate mass.

In another particularly preferred embodiment, a first imaginary plane for the conveyance of said aggregate passes over the upper surface of said conveyor means, and in that said at least one rotor is rotatably mounted about an axis oriented in a first direction perpendicular to said imaginary plane. This configuration reduces the efforts required for stirring the aggregate mass. Furthermore, the forward movement of the aggregate flow is also optimized, because despite being stirred, the forward movement of the mass takes place on a horizontal plane, and the aggregate mass therefore moves forward more smoothly. When the machine is supported on a horizontal surface, the imaginary plane for conveyance would be horizontal, such that the axis of the rotor would be vertical. Nevertheless, this does not always have to be the case, and the paver can work on an inclined plane.

In an alternative embodiment, a first imaginary plane for the conveyance of said aggregate passes over the upper surface of said conveyor means, and in that said at least one rotor is rotatably mounted about an axis oriented in a second direction parallel to said imaginary plane and perpendicular to said longitudinal direction of said paver. This configuration is particularly preferred when an increase in the aggregate mass stirring intensity is sought.

In another preferred embodiment, said mixing means comprise at least two rotors with a plurality of blades, and in that said at least two rotors rotate in opposite directions with respect to one another, which again considerably increases the homogenization of the aggregate mass, stirring the mass such that the hottest, innermost layers move towards the outer part of the mass. Preferably, said two rotors are arranged width-wise on said paver.

In another alternative embodiment, said mixing means comprise at least two rotors, a first rotor of said at least two rotors being offset with respect to the second rotor of said at least two rotors in the longitudinal direction.

Optionally, said mixing means are at least one worm screw and are arranged after said conveyor means.

In a particularly preferred manner, said mixing means are rotatably mounted about at least one axis oriented in the longitudinal direction. Assembly of the worm screw is thereby simpler. Alternatively, the worm screw may also be arranged in an upward direction and transverse to the direction of forward movement of the aggregate mass so as to increase the mixing of the aggregate mass.

In an improved embodiment the purpose of which is to maximize the homogenization of the asphalt aggregate when the rotor rotates about a vertical axis, said plurality of blades projects from said transversely, and preferably in the radial direction. It has been found that this embodiment intensifies the mixing movement in the aggregate mass, since it allows stirring across the entire width of aggregate mass being moved by the conveyor means.

On the other hand, to simplify construction of the rotors, the blades preferably project perpendicular to the first vertical direction.

It is also particularly preferred for said plurality of blades to be distributed along the height of said rotor. It is particularly desirable to form groups of blades grouped together projecting from the rotor by layers. In this case, the crossing points of the axes of the blades with the axis of the rotor of one and the same group of blades are preferably co-planar. In another particularly simple embodiment as regards its construction, the axes of the blades themselves of a group of blades are co-planar. In other words, each of the planes containing the axes of the blades of each group of blades is spaced a predetermined distance in height from the plane containing the axes of blades of the groups of adjacent blades, such that the aggregate mass is stirred by layers.

Also in a particularly preferred manner, the blades of a group of blades are uniformly distributed along the perimeter of the rotor. To make it easier to replace rotors, the blades of a group of blades are particularly preferred to be arranged at identical angular distances. For example, if there are four blades, the angular distance between blades is 90°.

In another embodiment, each blade of said plurality of blades is planar, and each blade forms an angle with respect to a horizontal plane, i.e., when the axes of the rotors are vertical, it would be with respect to the plane perpendicular to the first vertical direction.

The blades may also have a certain curvature along a generating trajectory along which they extend. Nevertheless, in a particularly preferred manner the blades are planar so as to simplify their manufacture.

Also in a particularly preferred manner, the blades are mounted such that the vertex of said angle is located in the front part, in the direction of rotation of said rotor, whereas in the adjacent rotor in the direction of forward movement of the aggregate, the vertex of said angle is located in the rear part in the direction of rotation of said rotor. As a result of this arrangement, an upward movement of the asphalt aggregate is generated, which intensifies the homogenization in order to then cause a downward movement in the adjacent rotor. This causes an additional mixing effect between layers, in the direction transverse to the direction of forward movement of the aggregate mass.

Finally, in a particularly preferred manner in order to intensify the homogenizing effect, said paver comprises connection means between rotors suitable for making adjacent rotors in the longitudinal direction of the paver rotate in opposite directions. An example of connection means may be, for example, chains or toothed belts, which allows moving the wheels of the rotors farther apart from one another and increasing the stirring area.

Likewise, the invention also includes other features of detail illustrated in the detailed description of an embodiment of the invention and in the accompanying figures.

BRIEF DESCRIPTION OF THE DRAWINGS

Further advantages and features of the invention will become apparent from the following description, in which, without any limiting character, preferred embodiments of the invention are disclosed, with reference to the accompanying drawings in which.

DETAILED DESCRIPTION

FIGS. 3 to 7 show a first embodiment of the asphalt aggregate paver 1 according to the invention for asphalting a surface 116 to be asphalted.

The paver 1 has a control cabin 18 under which the spreading elements are arranged.

Figure 1:
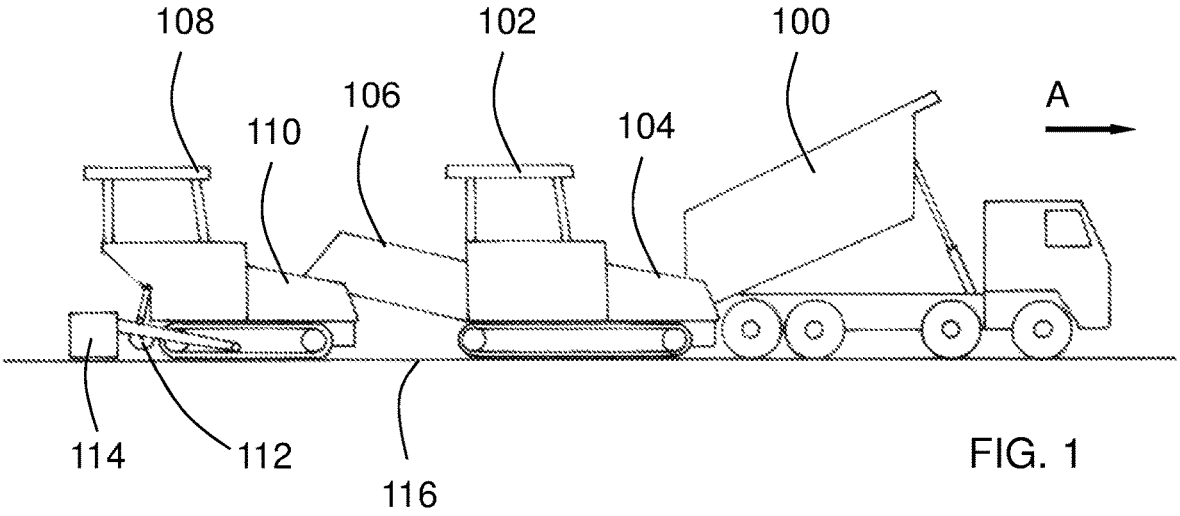
FIG. 1 shows a schematic side view of a known method for spreading asphalt aggregate.
Figure 2:
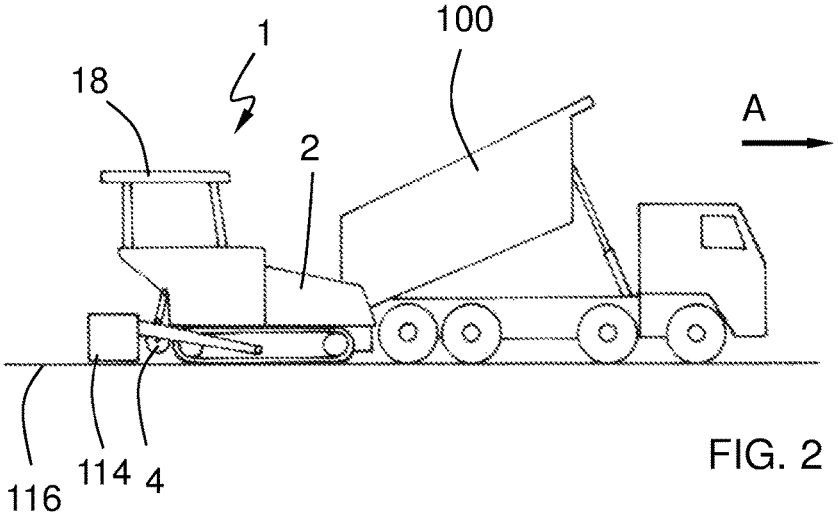
FIG. 2 shows a schematic side view of the method for spreading asphalt aggregate according to the invention.
Figure 3:
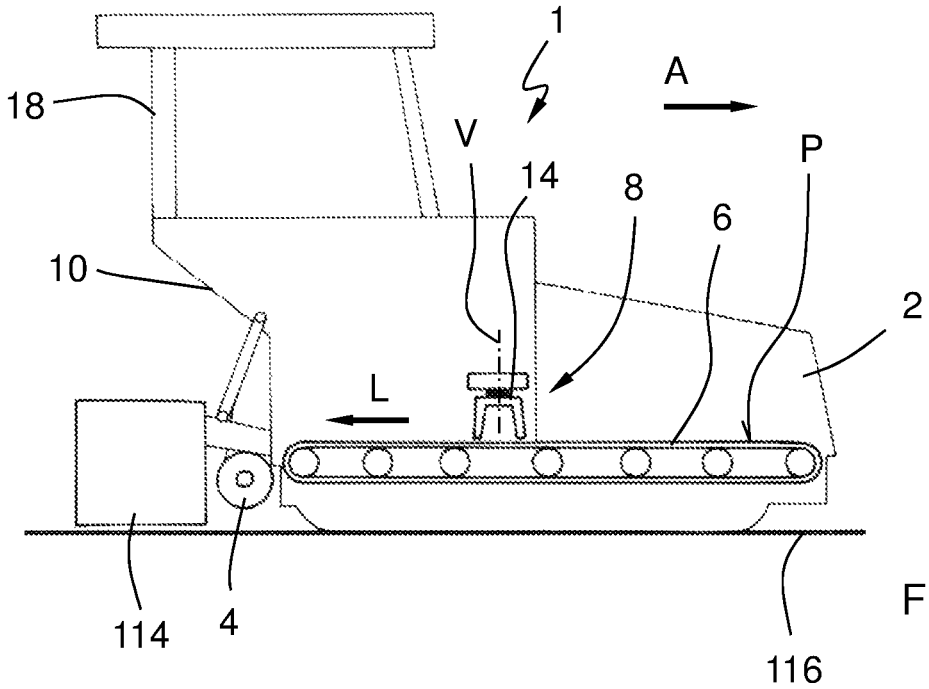
FIG. 3 shows a schematic side view of an asphalt aggregate paver according to the invention.
Figure 6:
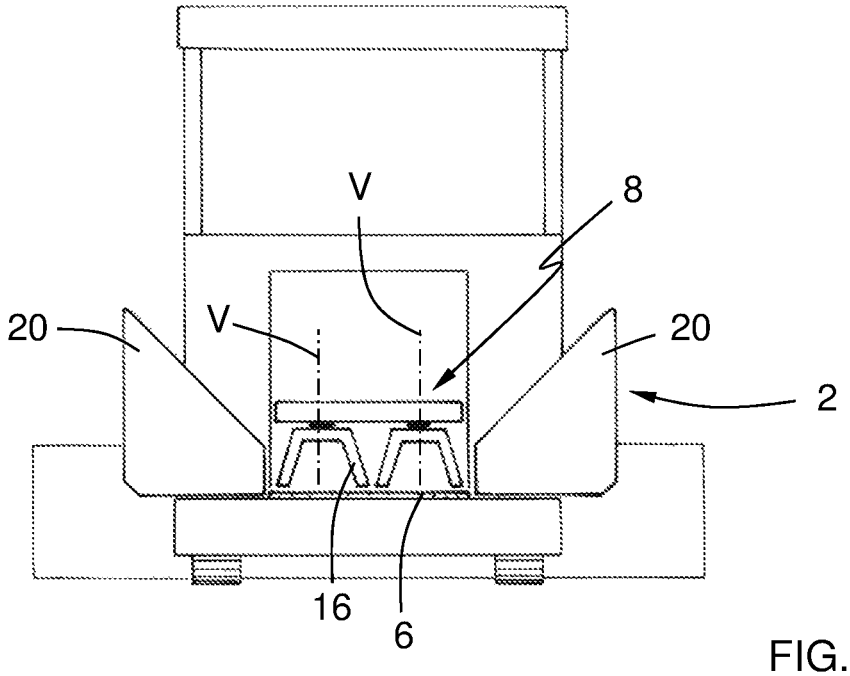
FIG. 6 shows a schematic front view of the paver of FIG. 3 with the receiving hopper in the maximum loading volume position.
Figure 7:
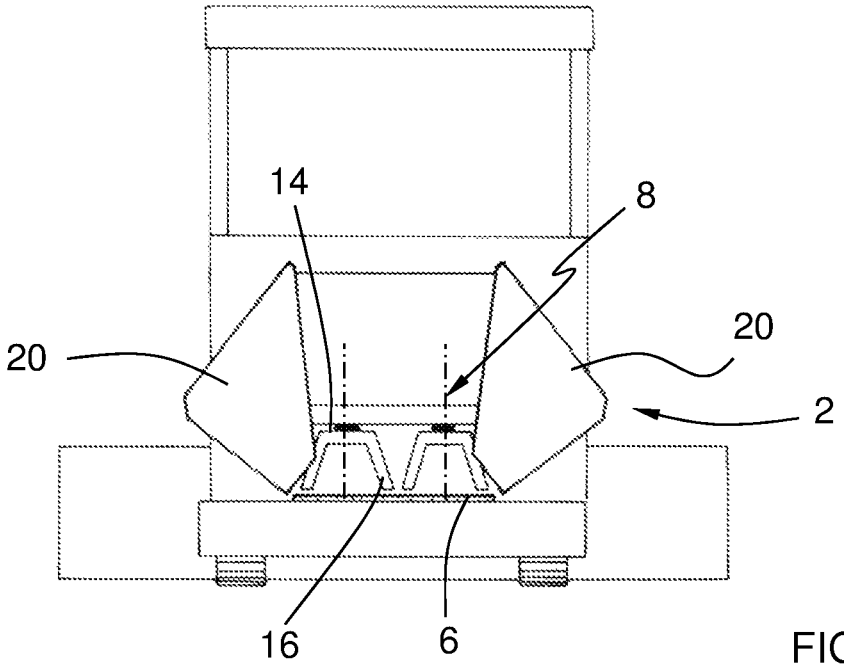
FIG. 7 shows a schematic front view of the paver of FIG. 3 with the receiving hopper in minimum loading volume position.

From right to left in FIG. 3, the paver 1 has a receiving hopper 2 for receiving asphalt aggregate. As can be seen in FIGS. 6 and 7, the receiving hopper 2 comprises two semi-casings 20, each of which is mounted in a rocking manner with respect to the body of the paver 1, about a longitudinal axis. This allows the aggregate not to get caught in the receiving hopper 2 and to be maximally utilized.

Behind the control cabin 18, the paver 1 has width-wise spreading means 4 for distributing the aggregate over the surface 116 to be asphalted. The spreading means 4 of this embodiment consist of a worm screw. The worm screw has a first half 22, with the blades oriented in one direction, and the second half 24, with the blades oriented in the direction opposite that of the first half 22. The worm screw is arranged in a direction transverse to the longitudinal direction L of the paver 1. The spreading means 4 can thereby distribute the aggregate over the surface 116 to be asphalted on both sides of the central axis of the paver 1.

To feed the spreading means 4, between the receiving hopper 2 and the spreading means 4 there are provided conveyor means 6 for feeding the spreading means 4. The conveyor means 6 convey the aggregate from the receiving hopper 2 to the spreading means 4, in the longitudinal direction L, parallel to the direction of forward movement A. The conveyor means are, for example, an articulated metal plate conveyor belt, capable of withstanding temperatures greater than 100° C. without becoming worn.

To solve the objectives of the invention, the paver 1 furthermore has mixing means 8. These mixing means 8 are a separate element of the conveyor means 6.

The mixing means 8 are arranged between the receiving hopper 2 and the spreading means 4. These mixing means 8 are movable with respect to the conveyor means 6. This movement has a direction that is different from the direction for the conveyance of the aggregate mass indicated by the longitudinal direction L.

The conveyor means 6 are, in that sense, exclusively in charge of longitudinally moving the aggregate mass. In contrast, the mixing means 8 stir the aggregate mass, such that the outer cold layers move towards the center of the mass and the inner hot layers move towards the surface. What matters is that the mixing means 8 and the conveyor means 6 have, at least at some time, different movement speeds and/or different movement directions, which causes the aggregate mass to be stirred.

It can be seen in the figures that the mixing means 8 are arranged outside and after the receiving hopper 2. To that end, the mixing means 8 are arranged inside a casing 10, after the receiving hopper 2. The casing 10 separates the mixing means 8 from the receiving hopper 2. This prevents the dump truck 100 from being able to damage the mixing means 8 when unloading the asphalt mass aggregate.

The mixing means 8 can perform different movements that allow homogenizing the aggregate mass. For example, linear movements in the direction opposite the direction for the conveyance of the aggregate mass can be conceived. The mixing means can also move by undulating movement along the longitudinal direction of conveyance.

Nevertheless, in this embodiment the mixing means 8 are arranged above said conveyor means 6 and are rotatably mounted about an axis.

More particularly, the mixing means 8 of this embodiment are formed by two rotors 14. Each rotor 14 has two blades 16 kneading the aggregate mass during conveyance. Each rotor 14 rotates about an axis transverse to the longitudinal direction L of the paver 1. The rotors 14 rotate in opposite directions with respect to one another, as can be seen with the arrows of FIG. 4.

Figure 4:
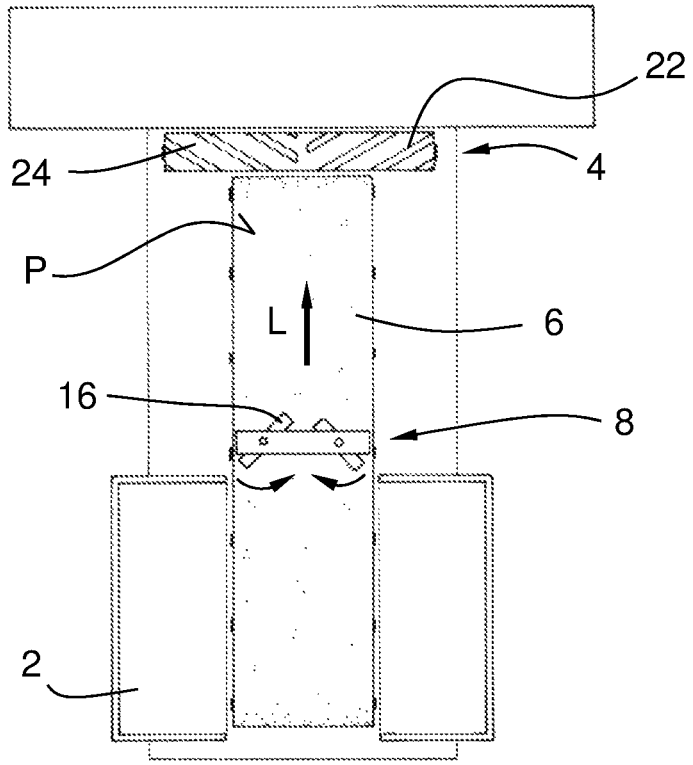
FIG. 4 shows a schematic sectioned top plan view of the paver of FIG. 3.
Figure 5:
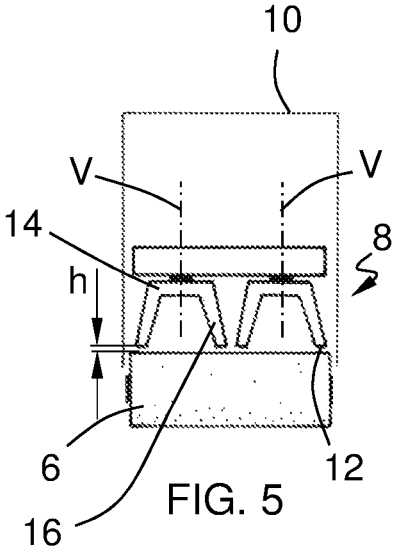
FIG. 5 shows a schematic front detail view of the mixing means of the paver of FIG. 3.

It can be seen in FIGS. 3 to 5 that in this case the axis of rotation is a vertical axis. Specifically, a first imaginary plane P for the conveyance of the aggregate which corresponds with the upper surface of the conveyor belt of FIG. 3 passes over the upper surface of the conveyor means 6. So in this case, each of the rotors 14 rotates about an axis oriented in a first vertical direction V, being perpendicular to the imaginary plane P. The vertical direction obviously refers to the direction of the drawing, since the actual direction depends on the angle of inclination of the surface to be asphalted.

It can be seen in FIG. 5 that the distal end 12 of the blades that constitute the mixing means 8 adjacent to the conveyor means 6 are arranged at a distance h comprised between 10 and 70 mm above the conveyor belt. In a particularly preferred manner, in order to reduce energy consumption of the mixing means without abandoning good homogenization, the distance h is comprised between 20 and 50 mm.

As a result of the paver 1 according to the invention, a novel asphalting method which is described below can be put into practice.

The asphalting method comprises a first step of receiving an asphalt aggregate mass in a receiving hopper 2.

Then the method comprises a step of conveying said aggregate mass in a longitudinal direction L, from said receiving hopper 2 to spreading means 4 configured for carrying out a step of spreading said aggregate width-wise over the surface 116 to be asphalted.

The method according to the invention comprises a step of mixing said asphalt aggregate using mixing means 8, said mixing step taking place between said receiving step and said spreading step for spreading the mass over the surface to be asphalted, said mixing step being independent of, but simultaneous to, a said conveying step.

Finally, the method comprises a spreading step for spreading said aggregate mass width-wise across said surface to be asphalted.

Said receiving, conveying, mixing, and spreading steps take place in one and the same paver.

Other embodiments of the paver according to the invention which share many of the features described in the preceding paragraphs are shown below. Accordingly, only the different elements will be described hereinafter, whereas reference is made to the description of the first embodiment for the common elements.

Figure 8:
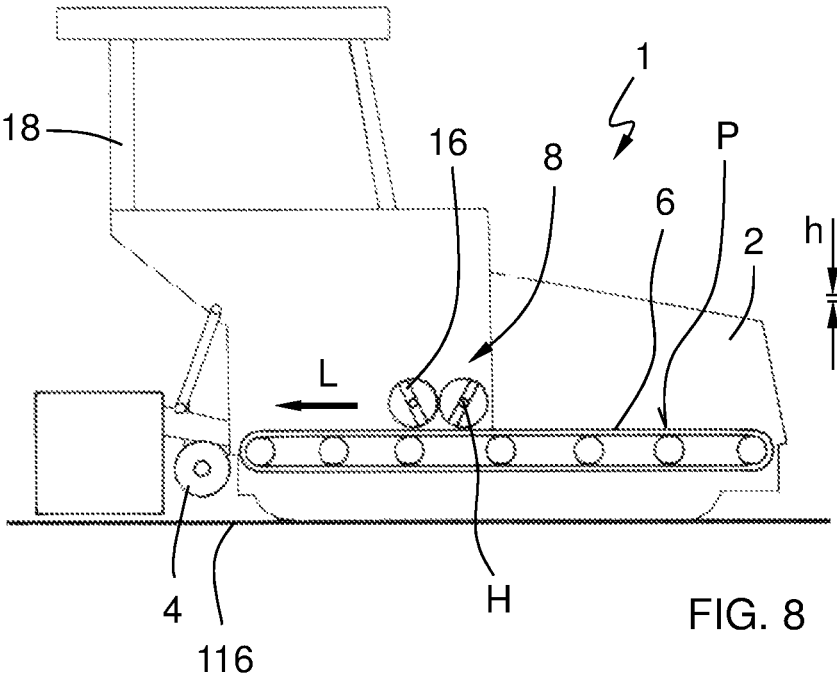
FIG. 8 shows a schematic side view of a second asphalt aggregate paver according to the invention.
Figure 9:
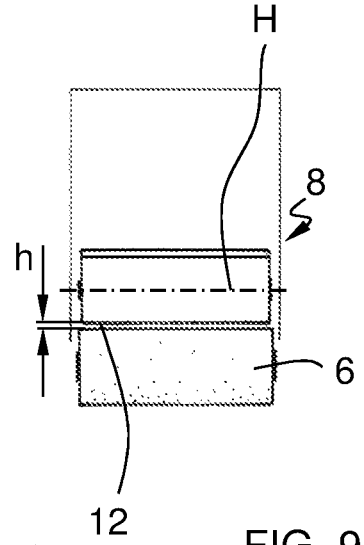
FIG. 9 shows a schematic front detail view of the mixing means of the paver of FIG. 8.

FIGS. 8 and 9 show a second paver 1 according to the invention. In this case, the mixing means 8 consist of two cylindrical rotors 14 with blades 16 extending along each of the cylinders.

In this case, the rotors 14 are oriented in a direction that is horizontal and transverse to the longitudinal direction L. More particularly, like in the preceding embodiment, a first imaginary plane P for the conveyance of the aggregate passes over the upper surface of the conveyor means 6. Each of the rotors 14 is rotatably mounted about an axis oriented in a second horizontal direction H, which is parallel to the imaginary plane P. Therefore, this axis is perpendicular to the longitudinal direction L of the paver 1. This arrangement provides a more intense mixing. Nevertheless, it requires a higher mixing power than the preceding embodiment does.

In this embodiment, furthermore, the two rotors 14 are offset with respect to one another. The first rotor 14, off to the side of the receiving hopper 2, is spaced from the second rotor 14 in the longitudinal direction L. This also increases homogenization of the aggregate mass in a notable manner.

Figure 10:
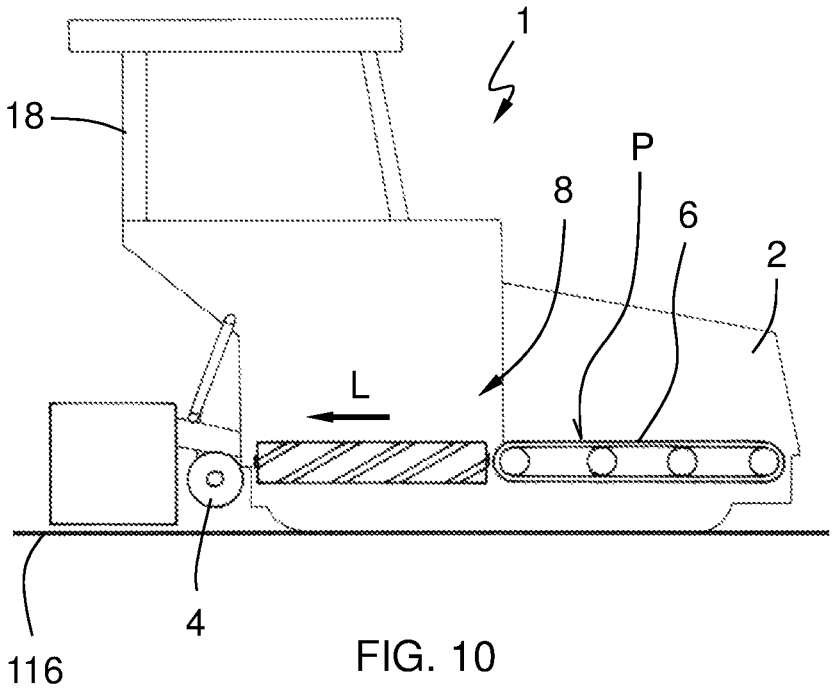
FIG. 10 shows a schematic side view of a third asphalt aggregate paver according to the invention.
Figure 11:
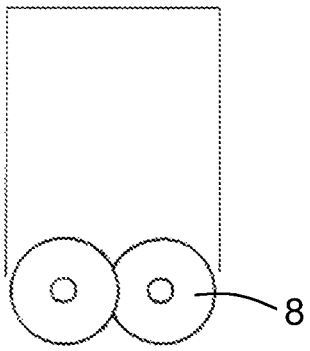
FIG. 11 shows a schematic front detail view of the mixing means of the paver of FIG. 10.

In the embodiment of FIGS. 10 and 11, the mixing means 8 are two worm screws arranged adjacent to one another, and they are rotatably mounted about axes oriented in the longitudinal direction L. In this case, these two worm screws are arranged after the conveyor belt.

Figure 12:
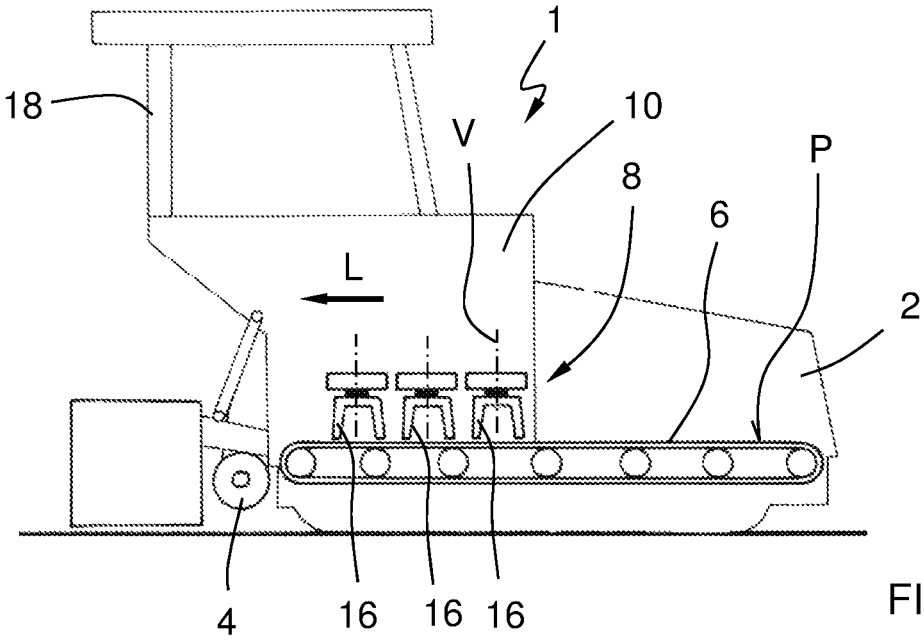
FIG. 12 shows a schematic side view of a fourth asphalt aggregate paver according to the invention.
Figure 13:
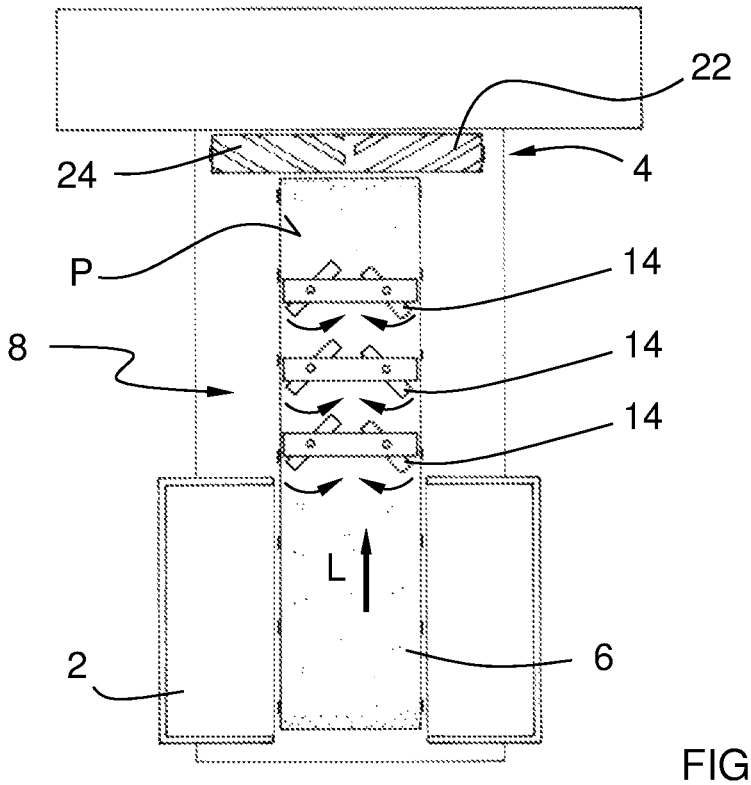
FIG. 13 shows a schematic sectioned top plan view of the paver of FIG. 12.
Figure 14:
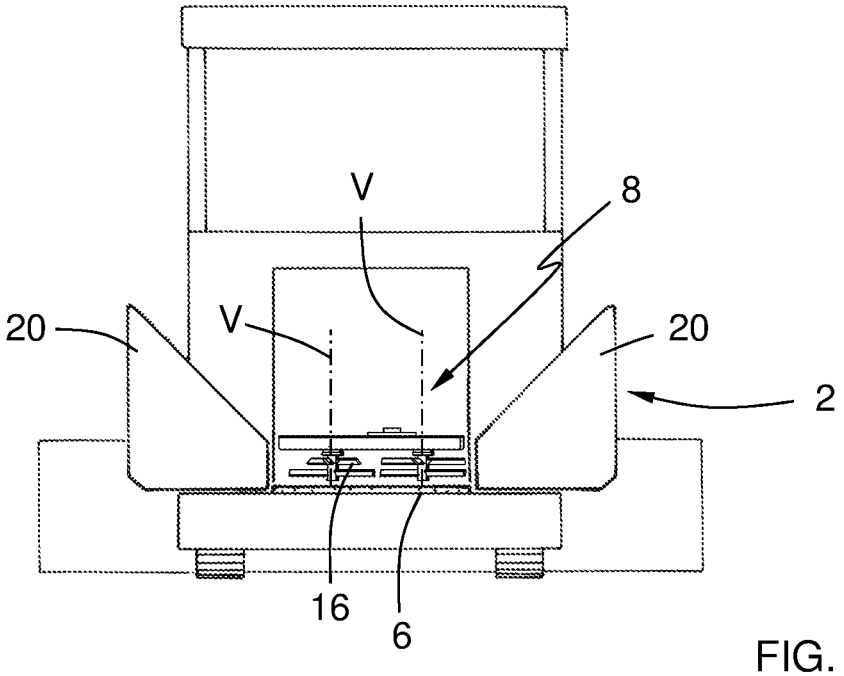
FIG. 14 shows a schematic front view of a fifth asphalt aggregate paver with the receiving hopper in the maximum loading volume position.

The embodiment of FIGS. 12 and 13 is based on the embodiment of FIGS. 3 to 7. In this case, the main difference consists of the mixing means 8 being formed by six rotors with a plurality of blades 16 arranged in twos. In this case, three rows of rotors 14 are formed. Each pair of rotors 14 of each row rotate in opposite directions with respect to one another, but furthermore, in the longitudinal direction L, the rotors 14 also rotate in directions opposite to the adjacent rotors 14, as indicated by the arrows in FIG. 13.

Figure 15:
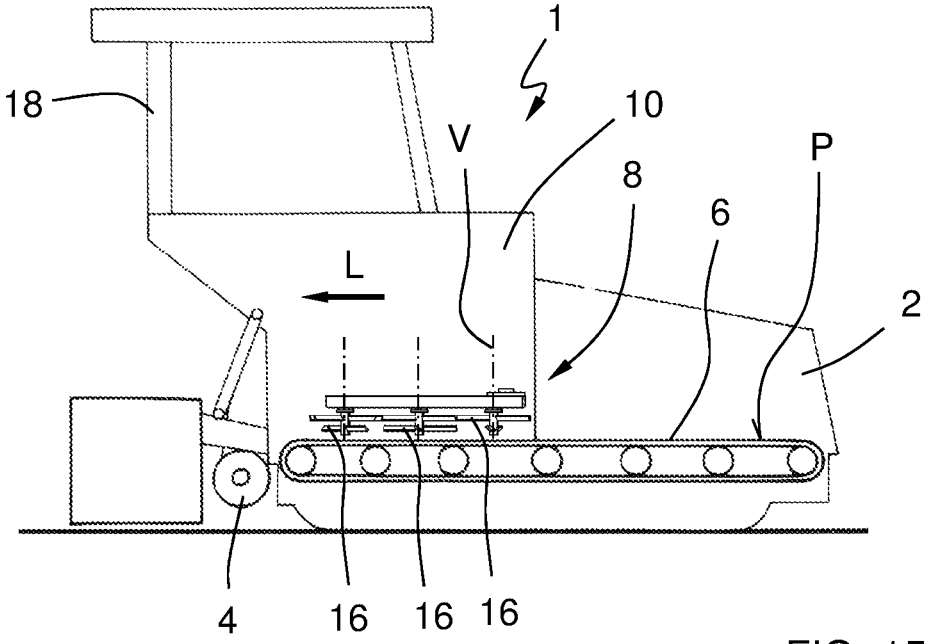
FIG. 15 shows a schematic side view of the paver of FIG. 14.
Figure 16:
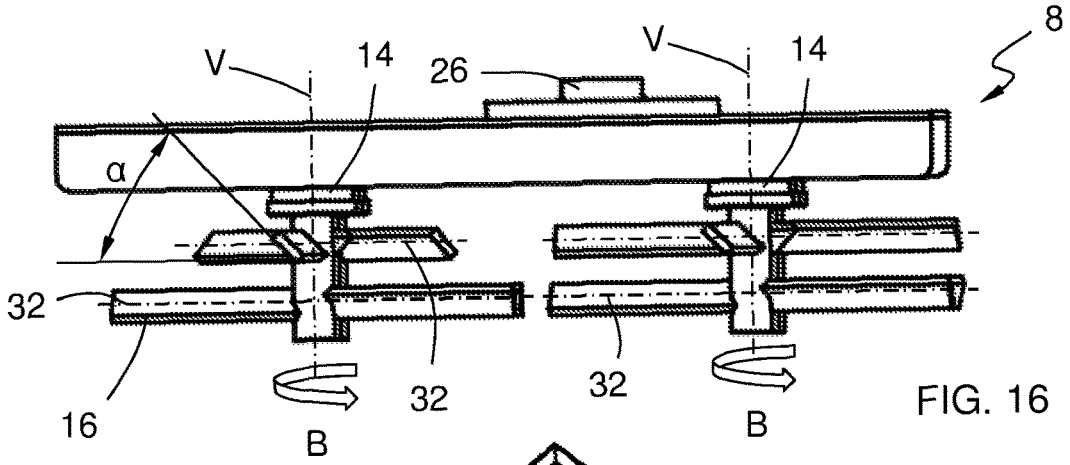
FIG. 16 shows a front perspective detail view of the mixing means of the paver of FIG. 14.
Figure 17:
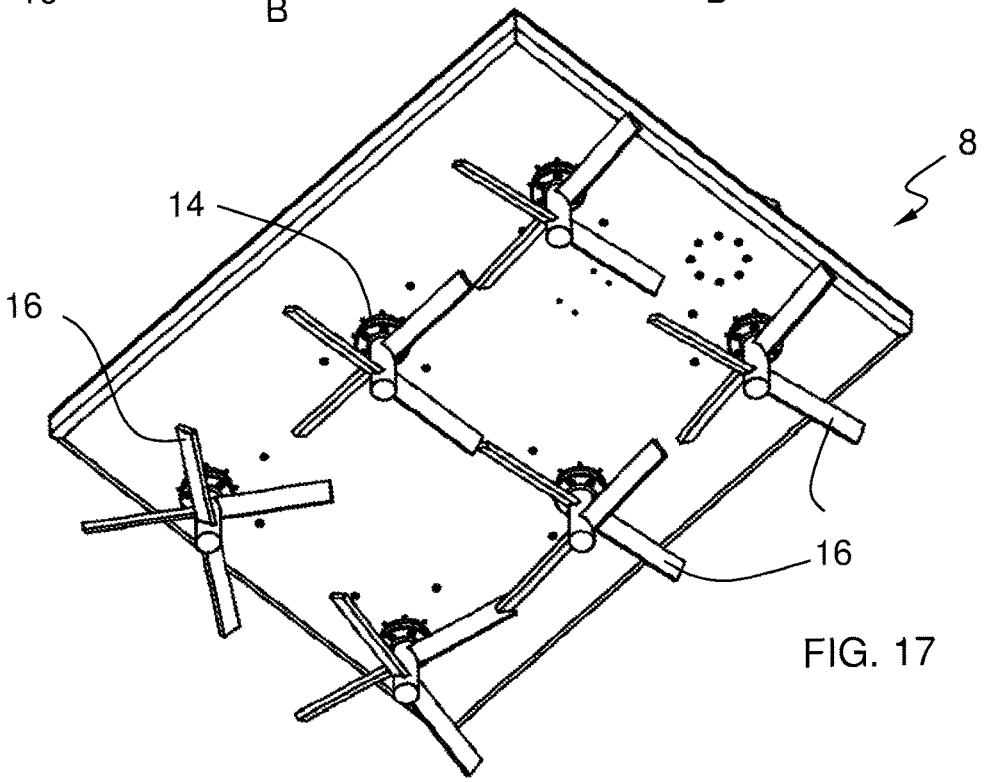
FIG. 17 shows a bottom perspective view of the mixing means of the paver of FIG. 14.

The paver 1 of FIGS. 14 to 18 is similar to the paver 1 of FIGS. 12 and 13, i.e., the rotors rotate about a vertical axis in the direction of the arrows B in FIG. 16. Furthermore, three pairs of rotors 14 uniformly distributed in the longitudinal direction L are provided in this case.

This embodiment differs from the embodiment of FIGS. 12 and 13 due to the fact that two groups of four blades 16 are provided in each rotor 14. Each group is distributed at a different height of each of the rotors 14 in the first vertical direction V. Depending on the dimensions of the paver 1, more than two groups of blades 16 could be provided.

On the other hand, it should be mentioned that the number of blades 16 in each of the groups should not be interpreted in a limiting manner either, since three, five, or more blades could be provided in each group of one and the same rotor 14.

In each group of blades 16, said blades 16 transversely project from the rotor 14 in the radial direction and are uniformly distributed about its perimeter. In particular, in this case, the blades 16 project perpendicular to the first vertical direction V, each blade forming an angle of 90° with respect to the adjacent blades. The blades 16 consist of laminar steel profiles with a rectangular cross-section, welded onto the axis of the rotor 14.

As can be seen in FIG. 16, to achieve better stirring, each blade of said plurality of blades 16 is planar and has its own generating blade axis 32.

The blade axes 32 of a group of blades are co-planar, in planes perpendicular to the first direction.

It can be seen in FIG. 12 that each blade 16 is tilted about its own blade axis 32, such that it forms an angle $\alpha$ with respect to a horizontal plane, i.e., with respect to the plane perpendicular to the axis of the first vertical direction V. Furthermore, it is particularly preferred for the vertex of the angle $\alpha$ of the blades of the first and third rows of rotors to be located up ahead, in the direction of rotation B of the blades. This orientation of the inclination has the effect of causing an upward pushing on the aggregate mass. This pushing improves the mixing action in the mass. In contrast, in the rotor 14 that is adjacent in the direction of forward movement of the aggregate the vertex of said angle is located in the rear part in the direction of rotation of said rotor. FIG. 15 shows this situation, in which despite the three pairs of rotors being identical, the rotors 14 in the middle rotate in the opposite direction of the first and third pairs of rotors.

In another embodiment not shown in the drawings, the blades 16 can be formed having a certain curvature along a generating trajectory.

Figure 18:
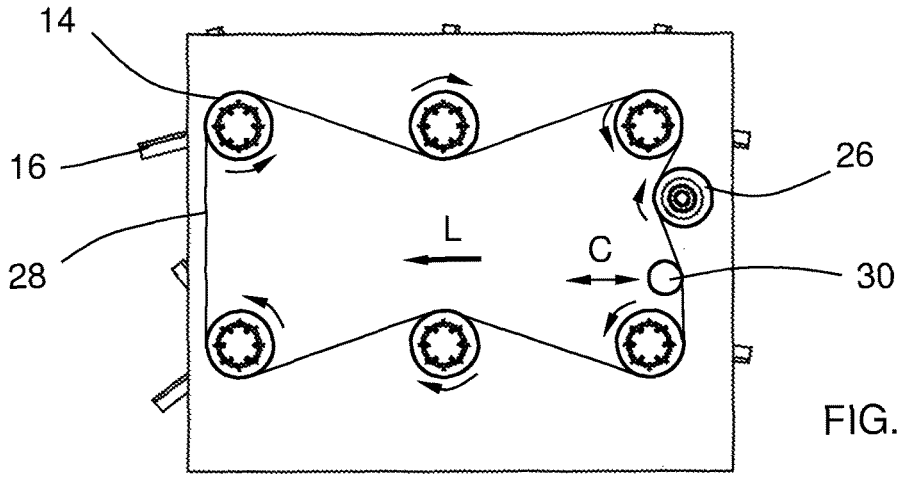
FIG. 18 shows a schematic top plan view of the inner mechanism of the mixing means of the paver of FIG. 14.

Finally, the driving principle of the six rotors 14 of this embodiment can be observed in FIG. 18. The drive wheel 26 is directly connected with the power output of the engine of the paver. In turn, each of the rotors 14 is meshed through a chain 28 with the drive wheel. As a result of this mechanism, two rotors 14 that are adjacent in the longitudinal direction L rotate in opposite directions.

A tensioning sprocket 30 which keeps the chain taut at all times as a result of it being movable in the direction of the double arrow C of FIG. 18 is also provided.

Finally, the effect of the inclination of the blades 16 with respect to their own axis depending on the direction of rotation of the blades can also be seen in FIG. 18. As can be seen, in the first and third rows of rotors 14, the blades 16 cause an upward movement of the aggregate. In contrast, in the second row of rotors 14, when the blades 16 rotate they cause a downward movement of the aggregate.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. An asphalt aggregate paver for asphalting a surface to be asphalted, said paver comprising a) a receiving hopper for receiving asphalt aggregate, b) width-wise spreading means for distributing said aggregate over said surface to be asphalted, and c) conveyor means arranged between said receiving hopper and said spreading means for feeding said spreading means, by conveying said aggregate from said receiving hopper to said spreading means in a longitudinal direction, wherein it further comprises d) mixing means, said mixing means being a separate element of said conveyor means, e) said mixing means being arranged between said receiving hopper and said spreading means and said mixing means being movable with respect to said conveyor means for stirring said aggregate when it is conveyed from said receiving hopper to said spreading means, and f) said mixing means being arranged outside and after said receiving hopper, wherein said mixing means are arranged above said conveyor means.

2. The paver according to claim 1, wherein said mixing means are arranged inside a casing, after said receiving hopper, separating said mixing means from said receiving hopper.

3. The paver according to claim 2, wherein said mixing means are rotatably mounted about an axis.

4. The paver according to claim 2, wherein said mixing means comprise at least one rotor with a plurality of blades, said at least one rotor being rotatably mounted about an axis transverse to the longitudinal direction of said paver.

5. The paver according to claim 1, wherein the distal end of said mixing means adjacent to said conveyor means is arranged at a distance comprised between 10 and 70 mm above said conveyor means and more preferably between 20 and 50 mm.

6. The paver according to claim 5, wherein said mixing means are rotatably mounted about an axis.

7. The paver according to claim 1, wherein said mixing means are rotatably mounted about an axis.

8. The paver according to claim 7, wherein said mixing means are at least one worm screw and are arranged after said conveyor means.

9. The paver according to claim 8, wherein said mixing means are rotatably mounted about at least one axis oriented in the longitudinal direction.

10. The paver according to claim 1, wherein said mixing means comprise at least one rotor with a plurality of blades, said at least one rotor being rotatably mounted about an axis transverse to the longitudinal direction of said paver.

11. The paver according to claim 10, wherein a first imaginary plane for the conveyance of said aggregate passes over the upper surface of said conveyor means, and in that said at least one rotor is rotatably mounted about an axis oriented in a second direction parallel to said imaginary plane and perpendicular to said longitudinal direction of said paver.

12. The paver according to claim 10, wherein a first imaginary plane for the conveyance of said aggregate passes over the upper surface of said conveyor means, and in that said at least one rotor is rotatably mounted about an axis oriented in a first direction perpendicular to said imaginary plane.

13. The paver according to claim 12, wherein said plurality of blades projects from said rotor transversely, and preferably in the radial direction.

14. The paver according to claim 13, wherein each blade of said plurality of blades is planar, and in that each blade forms an angle with respect to a horizontal plane.

15. The paver according to claim 13, wherein said plurality of blades are distributed along the height of said rotor in said first vertical direction.

16. The paver according to claim 10, wherein said mixing means comprise at least two rotors with a plurality of blades, and in that said at least two rotors rotate in opposite directions with respect to one another.

17. The paver according to claim 16, wherein said mixing means comprise at least two rotors, a first rotor of said at least two rotors being offset with respect to the second rotor of said at least two rotors in the longitudinal direction.

18. An asphalt aggregate paver for asphalting a surface to be asphalted, said paver comprising a) a receiving hopper for receiving asphalt aggregate, b) width-wise spreading means for distributing said aggregate over said surface to be asphalted, and c) conveyor means arranged between said receiving hopper and said spreading means for feeding said spreading means, by conveying said aggregate from said receiving hopper to said spreading means in a longitudinal direction, wherein it further comprises d) mixing means, said mixing means being a separate element of said conveyor means, e) said mixing means being arranged between said receiving hopper and said spreading means and said mixing means being movable with respect to said conveyor means for stirring said aggregate when it is conveyed from said receiving hopper to said spreading means, and f) said mixing means being arranged outside and after said receiving hopper, wherein said mixing means comprise at least one rotor with a plurality of blades, said at least one rotor being rotatably mounted about an axis transverse to the longitudinal direction of said paver.

19. An asphalt aggregate paver for asphalting a surface to be asphalted, said paver comprising a) a receiving hopper for receiving asphalt aggregate, b) width-wise spreading means for distributing said aggregate over said surface to be asphalted, and c) conveyor means arranged between said receiving hopper and said spreading means for feeding said spreading means, by conveying said aggregate from said receiving hopper to said spreading means in a longitudinal direction, wherein it further comprises d) mixing means, said mixing means being a separate element of said conveyor means, e) said mixing means being arranged between said receiving hopper and said spreading means and said mixing means being movable with respect to said conveyor means for stirring said aggregate when it is conveyed from said receiving hopper to said spreading means, and f) said mixing means being arranged outside and after said receiving hopper, wherein said mixing means are arranged inside a casing, after said receiving hopper, separating said mixing means from said receiving hopper, and wherein said mixing means are rotatably mounted about an axis.

* * * * *